US005447473A

United States Patent [19]

Scripps

[11] Patent Number: 5,447,473

[45] Date of Patent: Sep. 5, 1995

[54] CARPET COVER FABRIC FOR BOWLING PINSETTER

[75] Inventor: William J. Scripps, 9980 W. 178th St., Lakeville, Minn. 55044

[73] Assignee: William J. Scripps, Lakeville, Minn.

[21] Appl. No.: 272,792

[22] Filed: Jul. 11, 1994

[51] Int. Cl.[6] ..... A63D 5/00

[52] U.S. Cl. ..... 473/73; 473/93

[58] Field of Search ..... 473/54, 64, 73, 90, 473/91, 93, 94, 106, 114

[56] References Cited

U.S. PATENT DOCUMENTS

| | | | |
|---|---|---|---|
| 3,319,959 | 5/1967 | Lenhart | 473/93 |
| 3,358,813 | 12/1967 | Kohlhagen et al. | 473/93 |
| 3,880,424 | 4/1975 | Bockelman | 473/93 |

*Primary Examiner*—Vincent Millin
*Assistant Examiner*—William M. Pierce

[57] ABSTRACT

An improved cover for use with shaker boards in an automatic bowling pinsetter. The cover is a fabric that has the unique characteristic of a woven pile with a directional nap or slant in which all of the fibers of the pile extend in a common direction. The fabric produces better results in cleaning the balls, pins and in helping the pins exit off the shaker board.

1 Claim, 1 Drawing Sheet

CARPET COVER FABRIC FOR BOWLING PINSETTER

BACKGROUND OF THE INVENTION

1) Field of the Invention

This invention relates in general to Brunswick-equipped bowling centers and in particular to the carpet covers that cover the shaker board which is located in the ball return system of Brunswick bowling centers.

2) Prior Art

With a mandate several years ago from the American Bowling Congress to increase the use of oil placed on lanes, there has been a problem with bowlers getting their hands and clothes dirty. Over the years, various companies have made carpet covers, which are cloth products that adhere to the shaker board carpets with hook fasteners (e.g., Velcro®). The bowling center mechanic typically peels the carpet covers off the shaker board once a week to launder, and then puts them back on. Carpet covers serve to wipe the oil off the balls and pins and to lengthen the life of the shaker board carpet. There have been two problems with carpet covers in the past:

1) The absorbing fibers on the carpet cover fabric, which are intended to clean the oil off the balls and pins, wear off the carpet cover in a few weeks. This is because the fibers are produced by napping, an industrial abrasive process where the fabric passes under a cylindrical wire brush that scratches open the surface of the fabric, leaving fuzzy fibers to make it more absorbent. These wear off easily. 2) Often the bowling pins will stick to the fabric of the carpet cover, slowing up the game and irritating customers and proprietors.

SUMMARY OF THE INVENTION

The above problems have been solved by the use of a woven pile fabric with its directional "nap" or slant. There are other woven fabrics used in carpet covers, but they do not have a woven pile with its slant. In the invention's new-use process, I use a fabric that has a woven pile of fibers, similar to the construction of a woven carpet (FIG. 1). The fibers of this woven pile all have a common slant, similar to suede or velvet (FIG. 2). Objects, such as bowling pins, will encounter much more resistance going against this slant than they will going in the same direction. This common slant is often referred to as the "nap" of the fabric. So "nap" has two meanings: 1) the napping process that comes from abrasive wires, and 2) the direction of the fabric. This new fabric, with its woven pile and directional nap, has two unique advantages:

1) The absorbing fibers, woven in the pile, stay on much longer and do a better job of cleaning the lane oil off the balls and pins.

2) The nap (uniform direction), when facing the exit direction of the shaker board, greatly speeds up the exit of the pins, and so speeds up the game, pleasing the bowler and enriching the proprietor.

DETAILED DESCRIPTION OF THE INVENTION

Figure 1:
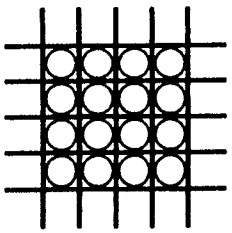
FIG. 1 is a top view, facing down, of a woven system with loops of fabric in place, forming the pile.
Figure 2:
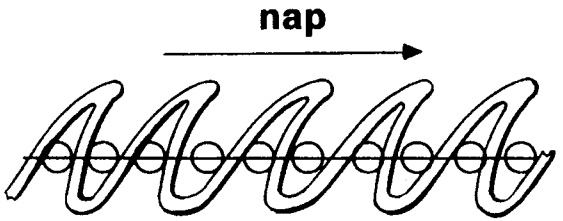
FIG. 2 is a side view of the same fabric, showing the nap (slant) of the woven pile.
Figure 3:
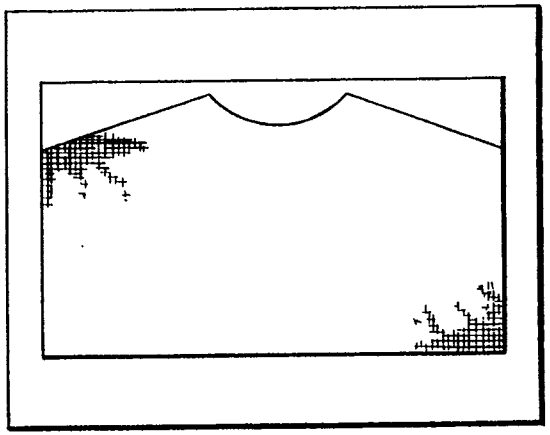
FIG. 3 is a top view of the shaker board (a) and carpet cover (b).
Figure 4:
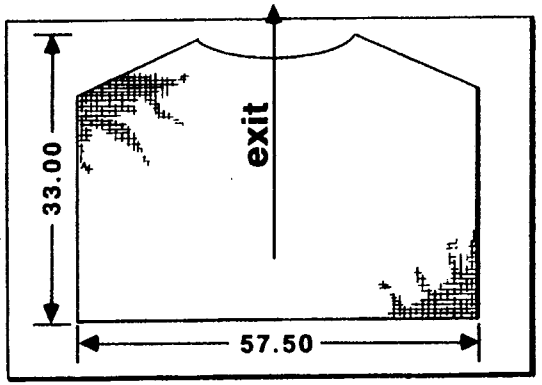
FIG. 4 shows the dimensions of the carpet cover and the exit direction of the pins.

As shown in the drawings, the fabric with the woven pile and its nap would be used in the manufacture of carpet covers for the shaker boards used in Brunswick-equipped bowling centers. The fabric's directional nap, when facing the exit direction, would greatly speed up the flow of the pins off the shaker board.

The deeper fibers of the woven pile would be taller, last longer, being locked in, and therefore clean better than the abrasive process used in prior art.

I claim:

1. An improvement a bowling pin setting apparatus of the type having a shaker board with a carpet, the improvement comprising;

a carpet cover having fibers arranged in a directional nap such that the fibers all extend at a slant in a common direction.

* * * * *